United States Patent [19]

Hicks et al.

[11] 4,440,394

[45] Apr. 3, 1984

[54] TOY PUZZLE

[75] Inventors: Alan A. Hicks, Chicago; Jeffrey D. Breslow, Highland Park, both of Ill.

[73] Assignee: Marvin Glass & Associates, Chicago, Ill.

[21] Appl. No.: 348,232

[22] Filed: Feb. 12, 1982

[51] Int. Cl.[3] ..... A63F 9/10

[52] U.S. Cl. ..... 273/157 R

[58] Field of Search ..... 273/157 R; 434/211, 434/214

[56] References Cited

U.S. PATENT DOCUMENTS

D. 190,660 6/1961 Mote ..... 273/157 R

FOREIGN PATENT DOCUMENTS 1088118 10/1980 Canada ..... 273/157 R 1037182 8/1958 Fed. Rep. of Germany ..... 434/214

2405077 5/1979 France ..... 273/153 S

OTHER PUBLICATIONS

"Action Fractions", One page advertising brochure of Schoolhouse Visuals, Inc., Copyright 1969.

*Primary Examiner*—Anton O. Oechsle

[57] ABSTRACT

A toy puzzle includes a base member with first and second rows of circular containers. One more container is in the first row than is in the second row. A plurality of playing pieces are to be positioned in the top row of containers in a predetermined pattern to define an object in each of the containers with one eye and an open mouth. The pieces may be repositioned in the second row of containers to form a closed mouth, one eyed object in each of the containers with no leftover pieces.

19 Claims, 7 Drawing Figures

TOY PUZZLE

BACKGROUND OF THE INVENTION

A. Field of the Invention

The present invention relates to a toy puzzle and in particular to a new and improved toy puzzle that in one formation of the puzzle, playing pieces define a plurality of objects of a first configuration and in a second formation define a plurality of objects of a second configuration.

B. Description of the Background Art

Toy puzzles are particularly entertaining when indoor entertainment is necessary such as on rainy or snowy days. The typical puzzle is formed by securing a picture onto a cardboard base and the picture and cardboard base are cut into a plurality of pieces each of a different configuration. Due to the picture image and the configuration of the pieces, the puzzle can be put together in only one way and with only the picture side of the puzzle being visible. The typical prior art puzzle of this type is educational in that it allows the user to learn the significance of configurations of parts and mentally determine where that part must be placed. The teaching of this skill is somewhat reduced, however, since the user can determine where a piece fits by the configuration of the piece and by the portion of the picture depicted on the individual piece. Also, while the mechanical aptitude that is exercised by putting together the typical prior art puzzle is beneficial, it does not exercise that mechanical aptitude that is exercised by being required to consider the possibility that some of the pieces of a puzzle must be inverted to complete the puzzle.

SUMMARY OF THE INVENTION

An object of the present invention is to provide a new and improved toy puzzle.

The present invention is directed to a new and improved toy puzzle that when assembled in a first formation, forms a plurality of objects in a first configuration. If assembled in a second formation, a plurality of objects of a second configuration are formed. The puzzle of the present invention includes a base member with first and second rows of cylindrical containers or holders. A plurality of puzzle parts are included that are portions of circular discs that are cut along radially extending lines to define the individual parts. Some of the parts include indicia in the configuration of an eye on at least one side. If the puzzle is properly assembled in the first row of containers, the puzzle parts form a plurality of open mouth, one-eyed objects in the containers. The puzzle parts may then be reassembled in the second row of containers and if properly assembled; define a closed mouth, one-eyed figure in each of the containers. The number of containers in the first row exceeds the number of the containers in the second row by one and the total number of puzzle parts equals the number of containers in the first row times the number of containers in the second row.

BRIEF DESCRIPTION OF THE DRAWINGS

The above and other objects and advantages and novel features of the present invention will become apparent from the following detailed description of the preferred embodiment of the invention illustrated in the accompanying drawings wherein.

BRIEF DESCRIPTION OF THE PREFERRED EMBODIMENT

Figure 1:
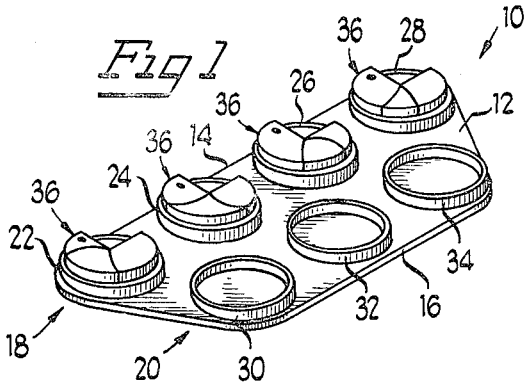
FIG. 1 is a perspective view of a puzzle with the pieces of the puzzle in a first configuration.
Figure 2:
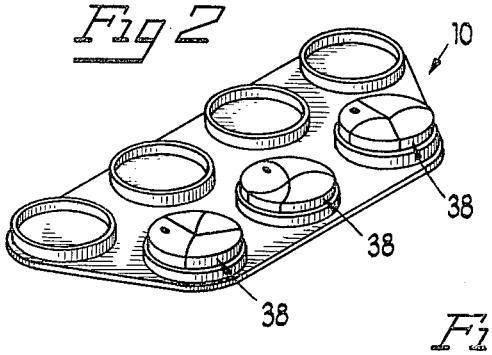
FIG. 2 is a perspective view of the puzzle of the present invention with the pieces of the puzzle in a second configuration.
Figure 3:
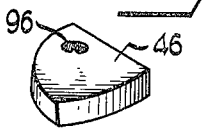
FIG. 3 is a perspective view of one piece of the puzzle of the present invention.

Referring now to the drawings and initially to FIGS. 1 and 2 there is illustrated a puzzle generally designated by the reference numeral 10, constructed in accordance with the principles of the present invention, that may be assembled in two different configurations. The puzzle 10 of the present invention, in addition to being entertaining, develops the mechanical aptitude of the user in that it requires mechanical manipulation through inversion of the parts to form the two different configurations.

The puzzle 10 of the present invention includes a planar base member 12 that is of a truncated triangular configuration being wider at the top 14 than at the bottom 16; however, it is to be understood that the configuration of the base is not intended to be limiting and the base 12 may be of many different configurations such as stepped or multilayer. First and second rows 18 and 20 of containers are defined in the base 12, which is conveniently made by conventional plastic forming techniques. The first row 18 includes four circular containers or holders 22, 24, 26, and 28 and the second row 20 includes three circular containers 30, 32, 34; however, it is to be understood that this number of containers is not intended to be limiting. The number of containers is subject to the requirement that the first row 18 include more containers than the second row 20, as illustrated, one more container.

The puzzle 10 may be assembled in the containers or holders 22, 24, 26 and 28 so as to form a particular figure 36 that in the preferred embodiment is a figure with an open mouth. Thereafter, the puzzle parts may be reassembled in the containers or holders 30, 32, and 34 to form a second figure 38, different from the first figure 36. In the preferred embodiment, the second figure includes a closed mouth. The puzzle 10 may advantageously correspond to a popular video game entitled "PAC-MAN" wherein a round circular figure opens and closes its mouth to consume objects. Accordingly, the figure 36 corresponds to a PAC-MAN figure with an open mouth and the figure 38 corresponds to the PAC-MAN figure with a closed mouth.

Figure 6:
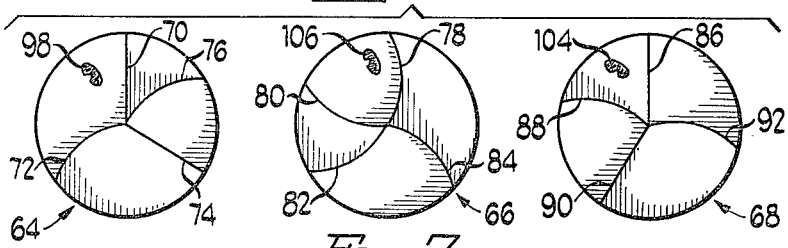
FIG. 6 is a top view of the puzzle pieces in the configuration illustrated in FIG. 2.

All of the puzzle parts are used in the first row 18 of containers to form the desired figures and all of the puzzle parts are also used in the second row 20 of containers to form the second figure. In the illustrated puzzle 10 there are twelve puzzle pieces 40–62. As best illustrated in FIG. 6, the puzzle pieces 40–62 may be formed by cutting them out of three discs generally designated 64, 66, and 68. While the puzzle parts can also be made using a variety of other techniques, including conventional plastic-forming techniques, the understanding of the present invention is facilitated by thinking of the puzzle parts as being "cut" from discs and this terminology will be used herein, without intending to limit the invention to any particular method of forming the parts. Radial cuts 70–92 are made in the discs 64, 66, and 68 extending from the center of each disc to its peripheral edge or rim. The number of discs 64, 66 and 68 corresponds to the number of containers or holders 30, 32, and 34 in the second row 20. The angle subtended by the open mouths of figures in row 18, conveniently equal in each figure, when totalled must equal 360° in the illustrated embodiment, so that the illustrated mouths subtend 90°. The number of puzzle pieces 40–62 may be equal to the number of containers or holders 22, 24, 26, and 28 in the first row 18 times the number of containers 30, 32 and 34 in the second row 20.

Figure 7:
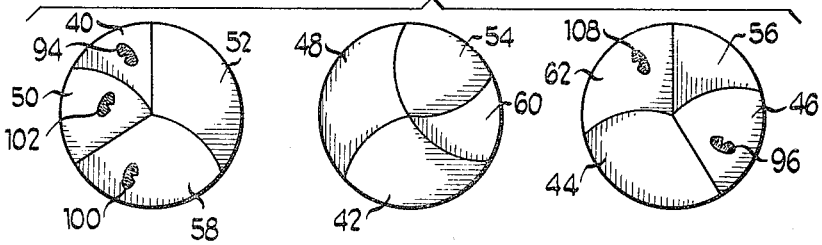
FIG. 7 is a bottom view of the puzzle pieces illustrated in FIG. 6.

In the puzzle 10 illustrated, the open mouths of the figures 36 are defined by straight lines that correspond to the straight cuts 70, 74, 86 and 90 in the discs 64 and 68. It is not intended that the straight cuts be the only type of cut defining the mouths of the figures 36; however, in the preferred embodiment, the number of cuts defining the mouths is equal to the number of containers 22, 24, 26 and 28 in the first row 18 of the puzzle 10. Upon examination of FIGS. 6 and 7, it will be noted that cuts complementary to the curvilinear cuts 72 and 76 in the disc 64 and the curvilinear cuts 88 and 92 in the disc 68 are made in the disc 66. In addition the curvilinear cuts preferably all have the same radius of curvature, equal to the radius of the discs 64, 66 and 68. This ensures that the correct puzzle pieces 40–62 fit together when properly combined in the containers 22, 24, 26, 28, 30, 32 and 34.

As can be understood upon viewing FIGS. 1 and 2, the initial step in playing the puzzle 10 is to position all the puzzle pieces 40–62 in either the first or second rows 18 and 20 of containers to form either the figure 38 or the figure 36 in each container. The next step is to move all the puzzle pieces 40–62 to form the other figure in the other row. For example, in FIG. 1 the user has positioned all of the puzzle pieces 40–62 in the containers 22, 24, 26, and 28 to create four of the open mouth figures 36. The next step is for the user to place all of the puzzle pieces 40–62 in the containers 30, 32, and 34 in the second row 20 to form three of the closed mouth figures 38. The steps involved in placing all the puzzle pieces 40–62 in the first row 18 of containers and then moving them into the second row 20 of containers involves the manipulation and inversion of pieces 40–62 to reassemble them into a different configuration. More specifically, each piece may be rotated around an axis perpendicular to the plane of the figure 36 or 38 and around any axis lying in the plane of the figure as well in order to fit the piece into the different configuration. In the reassembled puzzle an edge of certain pieces (for example pieces 50 and 54) which was internal in one configuration may become an external edge in another configuration.

Figure 4:
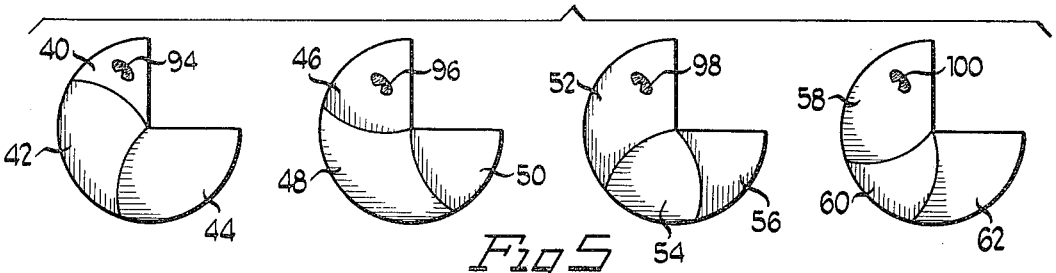
FIG. 4 is a top view of the pieces of the puzzle in the first configuration.
Figure 5:
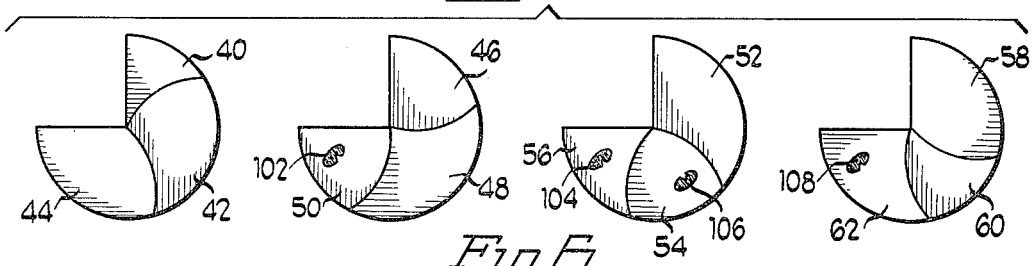
FIG. 5 is a bottom view of the puzzle pieces illustrated in FIG. 4.

The complexity of the puzzle 10 is increased through the use of indicia 94–108, on certain of the pieces, intended to be located adjacent the mouth of the completed figure 36 or 38. For example, the puzzle pieces 40, 46, 52 and 58 include eyes 94, 96, 98, 100 respectively on an upwardly facing side as pictured in FIG. 6. The puzzle pieces 50, 54, 56, and 62 include eyes 102, 106, 104, 108 respectively, depicted on the underside with respect to the position shown in FIG. 4, as illustrated in FIG. 5. As illustrated in the preferred embodiment, there are eight eyes 94–108 marked on the puzzle pieces. As can be understood, the number of eyes on the puzzle pieces 40–62 should at least equal the number of containers in the first row 18 of the puzzle 10. Preferably, assembly of the various pieces so that only one eye per figure 36 or 38 is facing upwardly is possible. Accordingly, not only must the user of the puzzle 10 be able to manipulate the puzzle pieces 40–62 in the correct manner to form the figure 36 or 38, but also must be sure that the mouth is opened as in figure 36 or closed as in figure 38 and that only one eye 94–108 is visible. This adds to the complexity of the puzzle further challenging the user's mechanical aptitude.

It should be understood that numerous modifications of the invention described herein can be devised by those skilled in the art that fall within the spirit and scope of the principles of this invention, even if the invention is not practiced as specifically described herein.

What is claimed and sought to be secured by Letters Patent of the United States is:

1. A puzzle comprising:

a plurality of puzzle pieces each including first and second sides, each of said puzzle pieces being of a shape to form a predetermined number of objects of a first configuration when said pieces are placed together in a first predetermined relationship with all of said pieces having the first side facing upwardly and to form a different number of objects of a second configuration when said pieces are placed together in a second predetermined relationship with at least some of said pieces having to be inverted so that said second side is facing upwardly in order to form the second configuration.

2. The puzzle set forth in claim 1 further comprising a first set of holders for each of said predetermined number of objects of said first configuration and a second set of holders for each of said different number of objects of said second configuration.

3. The puzzle set forth in claim 2 wherein said number of puzzle pieces is N which is an integer greater than 1, the number of holders in said first set is X, and the number of holders in said second set is $X-1$, and $N=X(X-1)$.

4. The puzzle set forth in claim 3 wherein the number of said pieces defining each of said objects of said first configuration is $X-1$ and the number of said pieces defining each said object of said second configuration is X.

5. The puzzle set forth in claim 1 wherein a predetermined number of said pieces include indicia on the first side of each said piece and a predetermined number of said pieces include indicia on the second side of each said piece.

6. The puzzle set forth in claim 5 wherein each object of said first configuration and each object of said second configuration includes only one piece on which said indicia is visible.

7. The puzzle set forth in claim 1 wherein said first configuration is a figure with an open mouth and said second configuration is a figure with a closed mouth.

8. The puzzle set forth in claim 1 wherein a preselected number of said pieces include at least two curvilinear sides, and at least one other piece includes a side complementary to one of said curvilinear sides.

9. A toy puzzle, comprising:

a base member, a first row of a plurality of containers on said base member, a second row of a plurality of containers on said base member, the number of containers in said first row is a whole number X, the number of containers in said second row is X−1, and a plurality of puzzle pieces of a configuration such that said pieces can be positioned in each of said first row containers in the form of one figure, and in said second row containers in the form of another figure.

10. The puzzle claimed in claim 9 wherein said containers are circular and said puzzle pieces when positioned in a first predetermined formation form a circular figure with an open mouth in each said container in said first row of containers and when positioned in a second predetermined formation form a circular figure with a closed mouth in each said container in said second row of containers.

11. The puzzle claimed in claim 9 wherein a predetermined number of said puzzle pieces include indicia and only one indicia is visible on each said figure.

12. The puzzle claimed in claim 9 wherein said puzzle pieces are formed by cutting a preselected number of discs along radii thereof, said preselected number of discs is X−1.

13. The puzzle claimed in claim 9 wherein said puzzle pieces are formed by cuts in a preselected number of discs, at least a predetermined number of said cuts are straight radial lines, said predetermined number of straight radial cuts is X.

14. A puzzle comprising:

a first row of circular containers, a second row of circular containers, said first row includes one more container than said second row, a number of generally pie-shaped puzzle pieces equal to the number of containers in said first row times the number of containers in said second row, and a preselected number of said puzzle pieces includes indicia on at least one side thereof.

15. The puzzle set forth in claim 14 wherein the number of said discs equals the number of containers in said second row.

16. The puzzle set forth in claim 14 wherein said indicia is a depiction of an eye.

17. The puzzle set forth in claim 14 wherein the number of said puzzle pieces including said indicia is equal to at least the number of containers in said first row.

18. The puzzle set forth in claim 14 wherein some of said pieces have more than one curvilinear edge, and the radius of curvature of all the curvilinear edges of all of said pieces is the same.

19. The puzzle set forth in claim 14 wherein said pieces can be arranged in a first configuration filling said second row containers and in a second configuration partially filling each of the containers of said first row, defining an identical pie-shaped void in each container.

* * * * *